United States Patent [19]

Milo

[11] 4,399,923

[45] Aug. 23, 1983

[54] TANK BOTTOM SHIELD

[76] Inventor: August Milo, 478 Schiller St., Elizabeth, N.J. 07206

[21] Appl. No.: 308,141

[22] Filed: Oct. 5, 1981

Related U.S. Application Data

[63] Continuation-in-part of Ser. No. 275,807, Jun. 22, 1981.

[51] Int. Cl.[3] ..... B65D 90/48

[52] U.S. Cl. ..... 220/85 R; 220/19; 33/126.7 R; 73/290 R

[58] Field of Search ..... 220/19, 85 R, 86 R, 220/86 AT; 33/126.7; 73/290, 298; 15/246.5

[56] References Cited

U.S. PATENT DOCUMENTS

| | | | |
|---|---|---|---|
| 1,429,198 | 9/1922 | Fanncett | 220/19 |
| 1,736,842 | 11/1929 | Wilcox | 220/85 R |
| 1,830,116 | 11/1931 | Kralt | 73/290 R |
| 1,846,618 | 2/1932 | Shield | 220/86 R |
| 1,935,044 | 11/1933 | Davis | 220/85 R |
| 2,086,645 | 7/1937 | Staber | 73/120 |
| 2,294,176 | 8/1942 | Gretell | 220/86 R |
| 2,371,241 | 3/1945 | Jaffa | 220/86 AT |
| 2,615,576 | 10/1952 | Dahlgren | 220/19 |
| 2,659,484 | 11/1953 | Averill | 220/19 |
| 3,464,584 | 9/1969 | McNally | 220/86 R |

FOREIGN PATENT DOCUMENTS

| | | | |
|---|---|---|---|
| 898207 | 4/1945 | France | 33/126.7 |

*Primary Examiner*—George E. Lowrance
*Attorney, Agent, or Firm*—Karl L. Spivak

[57] ABSTRACT

A shield is disclosed which protects the bottom of liquid filled tanks in general and underground flammable liquid storage tanks in particular. The shield is slidably secured near the bottom of the fill drop tube which is positioned within the tank. The shield bottomly covers the drop tube in a manner to protect the tank construction during stick gauging. When a gauge stick is dropped into the tank through the fill opening to measure the quantity of liquid contained therewithin, the gauge stick strikes the shield and not the bottom of the tank.

7 Claims, 14 Drawing Figures

TANK BOTTOM SHIELD

RELATED APPLICATION

This application is a continuation-in-part of my copending application, Ser. No. 275,807, filed June 22, 1981 and entitled "Tank Bottom Shield".

BACKGROUND OF THE INVENTION

This invention relates to an apparatus for protecting the bottoms of liquid filled tanks in general and underground flammable liquid storage tanks in particular.

As has been set forth in the above-referenced application, graduated gauge sticks are commonly used to measure the quantity of a liquid in an underground tank by introducing the elongated gauge stick from ground level through the fill opening. To do so, typically, the gauge stick or rod is dropped through the fill opening into the tank until the stick touches bottom, whereupon it is removed for a determination of the height of the liquid within the tank by observing the wetted portion of the gauge stick.

The combined frequency generated by the application of gauge sticks and other objects such as sharp edges of suction pipes used with sludge water removal pumps to the bottom of the tank has resulted in punctures to the tank, especially in underground tanks which are fabricated of fiberglass. These punctures usually require the replacement of the entire tank, an expensive and time consuming operation. Where the puncture results in leaks of flammable or toxic liquids, serious safety hazards can be created.

SUMMARY OF THE INVENTION

The present invention relates generally to underground tank installations, and more particularly, is directed to a device suitable to protect the bottom of an underground flammable liquid storage tank from damage caused by stick gauging procedures. The invention includes a shield which may be easily and simply adapted to an existing fill drop tube in use in underground gasoline and other product storage tanks.

The shield comprises a substantially flat strike plate connected to a plurality of upwardly extending arms, which arms are preferably outwardly spring biased. The shield can be conveniently positioned in a drop tube from above by sliding the shield base down through the drop tube or by first removing the drop tube from the tank and inserting the arms of the shield into the drop tube bottom end. To do so, due to their spring bias, one must hold the arms together to clear the smaller circumference of the drop tube. The shield is slidably engaged within the drop tube by the frictional engagement of the spring biased arms against the interior of the drop tube. After the tank shield is properly placed in the storage tank, the shield will be interposed between the bottom of the tank and the bottom of the measuring gauge stick, to thereby prevent direct contact between the bottom of the gauge stick and the bottom of the tank.

It is therefore an object of the present invention to provide an improved apparatus for protecting the bottom of a tank from the effects of stick gauging.

It is another object of the present invention to provide an insertable shield for protecting the bottom of a liquid filled tank from damage by a conventional measuring gauge stick.

It is another object of the present invention to provide an easily installed tank bottom shield for protecting the bottom of an underground flammable liquid storage tank.

It is still another object of the present invention to provide an adjustable shield apparatus within the fill drop tube for protecting the bottom of an underground flammable liquid storage tank when the contents thereof are being measured through the use of a conventional measuring gauge stick.

It is still another object of the present invention to provide a tank bottom shield having a strike plate for protecting the bottom of an underground flammable liquid storage tank and including a plurality of spring biased arms for associating the shield within the drop fill tube.

It is still another object of the present invention to provide a tank bottom shield for protecting the bottom of an underground flammable liquid storage tank by providing a shield including means for slidable engagement within the drop fill tube.

It is still another object of the present invention to provide a tank bottom shield for protecting the bottom of a tank comprising means which will distribute the forces of impact caused by the dropping of a measuring gauge stick on the bottom of the tank over an enlarged area of the bottom of the tank.

Other objects and a fuller understanding of the invention will be had by referring to the following description and claims of a preferred embodiment thereof, taken in conjunction with the accompanying drawings, wherein like reference characters refer to similar parts throughout the several views, and wherein:

DESCRIPTION OF THE PREFERRED EMBODIMENTS OF THE INVENTION

Figure 1:
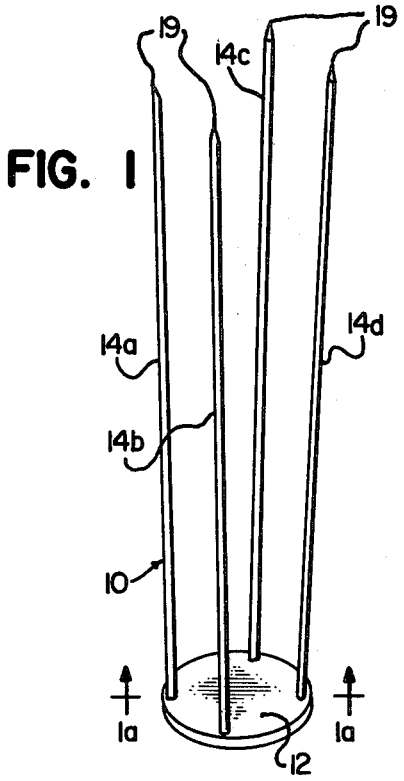
FIG. 1 is a perspective view of one embodiment of the invention.

Although specific terms are used in the following description for the sake of clarity, these terms are intended to refer only to the particular structure of the invention selected for illustration in the drawings and are not intended to define or limit the scope of the invention.

Figure 1A:
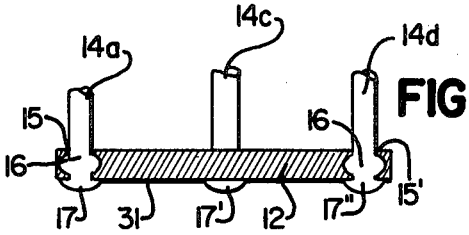
FIG. 1*a* is an enlarged, cross sectional view taken along line 1*a*—1*a* on FIG. 1, looking in the direction of the arrows.

Referring now to the drawings, a first embodiment of the tank bottom shield 10 is illustrated in FIGS. 1 and 1*a*. The shield comprises a disc-like, metallic baseplate or strike plate 12 and a plurality of upwardly extending, radially outwardly extending, attaching legs 14*a*, 14*b*, 14*c*, 14*d*. The baseplate 12 is preferably fabricated of sturdy material, to absorb repeated blows or impacts of the bottom of a conventional gauge stick or rod (not shown) as the gauge stick is employed in well known manner to measure the liquid contents of an underground liquid storage tank (also not shown). A distinguishing feature of the first embodiment is illustrated in FIG. 1*a* wherein the legs 14*a*, 14*b*, 14*c*, 14*d*, are affixed to the baseplate 12 by peening. Holes 15, 15' are peripherally provided in the baseplate 12, one for each leg, and the legs are inserted through the holes 15, 15' until their respective bottom ends 16 extend through the bottom 31 of the baseplate 12. The leg bottoms 16 are then peened in conventional manner to provide expanded, bottom heads 17, 17', 17'', as best seen in FIG. 1*a*. The flow of material which causes the formation of the bottom heads 17, 17', 17'' expands the respective leg bottoms 16 within the baseplate holes 15, 15', causing the parts to be strongly secured together.

The arms 14*a*, 14*b*, 14*c*, 14*d* are spring biased radially outwardly to thereby frictionally engage the interior of the fill drop tube (not shown) when installed therein. To achieve satisfactory spring bias, the arms 14*a*, 14*b*, 14*c*, 14*d* may be fabricated of one-quarter inch diameter steel rod and positioned within the baseplate 12 so that the upper ends 19 are spaced further apart than the respective base ends 16.

Figure 2A:
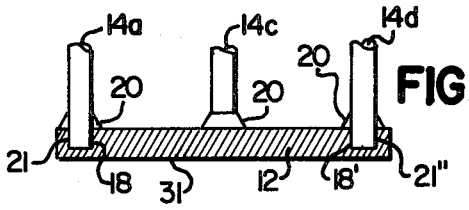
FIG. 2*a* is an enlarged, cross sectional taken along line 2*a*—2*a* on FIG. 2, looking in the direction of the arrows, showing a modified connection construction.
Figure 2:
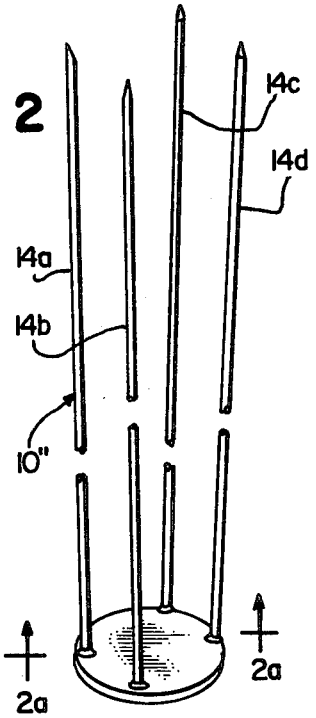
FIG. 2 is a perspective view of a second embodiment of the invention.

FIGS. 2 and 2*a* illustrate a second embodiment 10' of the invention which is similar to the first embodiment of FIG. 1 except at the attachment of the bottoms 18 of the legs to the base 12. In this embodiment, each leg 14*a*, 14*b*, 14*c*, 14*d* is inserted respectively into a hole 21, 21, which holes are drilled only part way through the baseplate 12. Each leg is inserted into its hole 21—21 and is secured therein by the application of a peripheral weld bead 20 which is preferably continuous about the periphery of each leg at the bottom 18, 18' thereof.

Figure 3A:
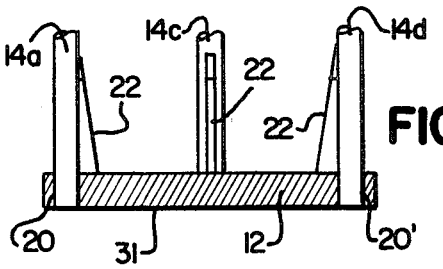
FIG. 3*a* is an enlarged, cross sectional view taken along line 3*a*—3*a* on FIG. 3, looking in the direction of the arrows.
Figure 3:
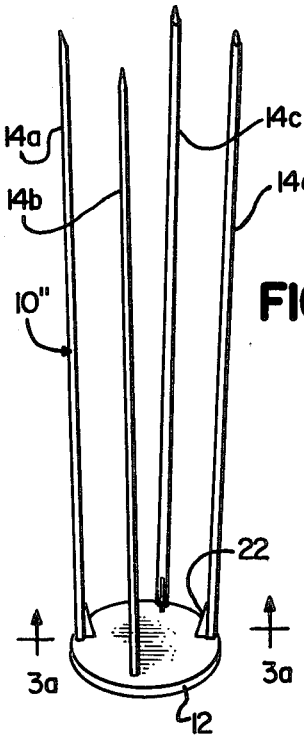
FIG. 3 is a perspective view of a third embodiment of the invention.

FIGS. 3 and 3*a* illustrate a third embodiment 10'' of the invention which is similar in concept to the first and second embodiments except with respect to the attachment of the legs to the baseplate 12. In this embodiment, the baseplate is provided with a plurality of openings 20, 20' and the bottoms of the legs 14*a*, 14*b*, 14*c*, 14 *d* are positioned respectively therein. With the legs in place, triangular gussets 22 are placed with one edge in parallel abutment with a leg and a second edge in parallel abutment with the baseplate 12. Each gusset 22 is then welded to the leg and baseplate surfaces and the leg is welded to the baseplate along the abutting surfaces. The angle between the two welded edges of the gusset 22 will be slightly in excess of ninety degrees, thereby to cause the legs 14*a*, 14*b*, 14*c*, 14*d* to be biased outwardly.

Figure 4:
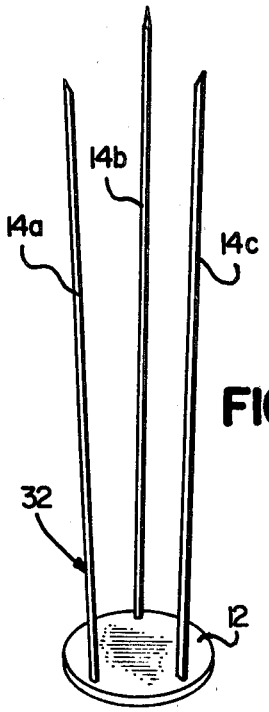
FIG. 4 is a perspective view of a fourth embodiment of the invention.

Referring now to FIG. 4, there is illustrated a fourth embodiment 32 of the tank bottom shield wherein only three legs 14*a*, 14*b*, 14*c* are attached to the baseplate 12 at equal distances apart from each other. To secure the legs to the baseplate in this embodiment, any of the previously mentioned methods of attachment may be employed.

Figure 5:
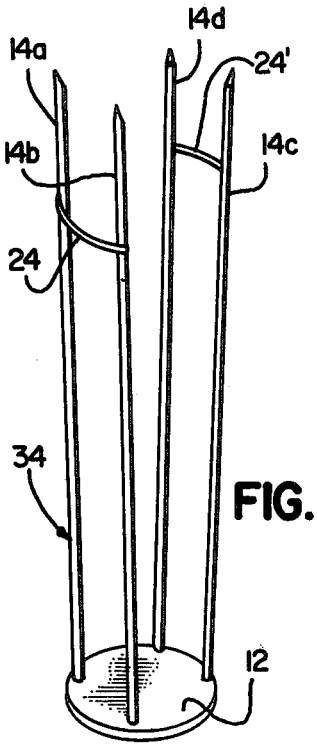
FIG. 5 is a perspective view of a fifth embodiment of the invention.

FIG. 5 shows a four-legged embodiment 34 of the device wherein adjacent pairs of legs 14*a*, 14*b*, 14*c*, 14*d* are connected to each other by a tie bar 24, 24'. The tie bars serve to convert the radially outwardly directed forces of the four legs which extend in four independent directions, into two equal forces which project in diametrically opposed directions. The tie bars 24, 24' are preferably placed closer to the free terminus of each leg than to the base ends of the legs, to effectively consolidate the outward bias of the four legs into the two opposite directions. The tie bars 24, 24' each consists of a thin strip or rod of metal which is attached to the legs by welding or other conventional means. As illustrated, the tie bars 24, 24' are curved to conform to the internal curvature of the associated fill drop tube (not shown) to thereby not interfere with the free sliding action of the shield 34 within the drop tube. Any conventional or previously illustrated attachment means may be used to attach the legs 14*a*, 14*b*, 14*c*, 14*d* to the baseplate 12.

Figure 6:
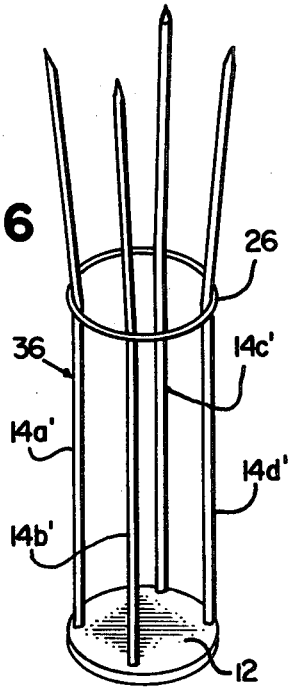
FIG. 6 is a perspective view of a sixth embodiment of the invention.

In the sixth embodiment 36 of FIG. 6, the outward spring bias in the legs 14*a'*, 14*b'*, 14*c'*, 14*d'* is confined to the upper portions when viewed in the orientation in which the shield will be disposed within the tank. The legs are secured by a ring 26, which ring encircles the legs at the height at which the legs are bent outwardly, to create their collective radially outward bias. The ring 26 may be attached to the legs and the legs to the base by welding or other conventional means.

Figure 7:
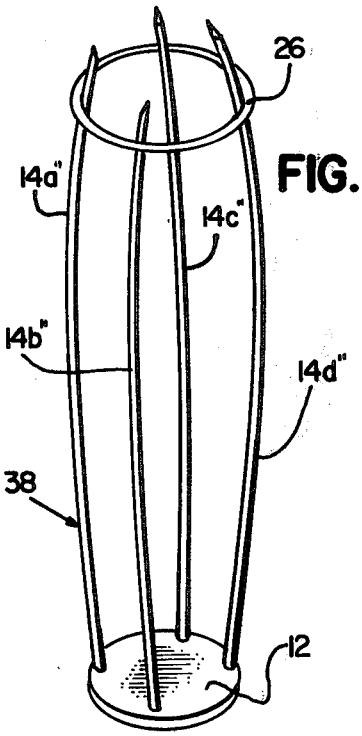
FIG. 7 is a perspective view of a seventh embodiment of the invention.

In the embodiment 38 of FIG. 7, the ring 26 has been secured near the free terminal portions of the legs 14*a''*, 14*b''*, 14*c''*, 14*d''* causing the legs to bow outwardly, whereby the medial portions of the legs will engage the interior surface of the fill drop tube (not illustrated). The ring 26 is sized to loosely slide within the inner periphery of the drop tube so that the outward medial bow of the legs will result in the shield 38 fitting snugly within the tube. The ring 26 may be attached to the legs by welding or other known, secure manner. Again, the legs may be attached to the baseplate 12 in any manner which results in the outwardly spring biased bow, as illustrated.

Figure 8:
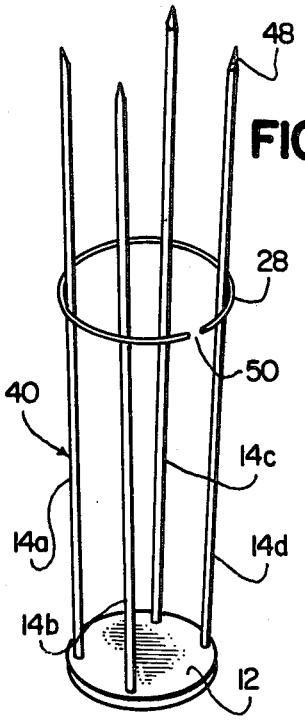
FIG. 8 is a perspective view of a eighth embodiment of the invention.

In the embodiment of the shield 40 which is illustrated in FIG. 8, the legs 14*a*, 14*b*, 14*c*, 14*d* are encircled with a split ring 28 at roughly their midpoint. The outer circumference of the ring 28 when closed, should be smaller than interior diameter of the drop tube (not shown). The circumference of the circle defined by the points at the free ends 48 of the legs 14*a*, 14*b*, 14*c*, 14*d*, with the ring 28 open at 50 will be larger than interior diameter of the drop tube. Consequently, the shield 40 will still be held in place by the spring bias of the legs. The ring 28 and the baseplate 12 may be secured to the legs by welding or other known, conventional manner.

Figure 9:
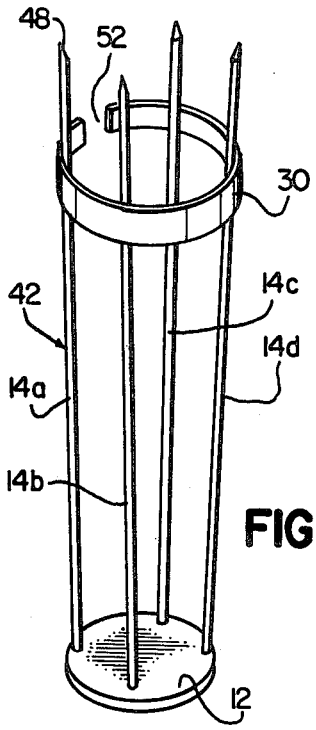
FIG. 9 is a perspective view of a ninth embodiment of the invention.

The embodiment 42 illustrated in FIG. 9 is similar to that shown in FIG. 8 except that the ring 30 may be constructed of a sheet metal strip and welded to the legs 14*a*, 14*b*, 14*c*, 14*d*. The split area 52 functions in the same manner as the split 50 in FIG. 8.

Figure 10:
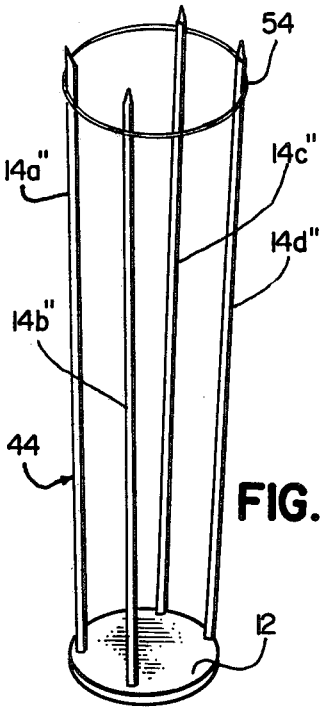
FIG. 10 is a perspective view of a tenth embodiment of the invention.

The embodiment 44 in FIG. 10 relies on a close fit within the drop tube (not shown) rather than on spring biased legs to maintain correct orientation within the drop tube. A ring 54 is secured near the tops of the legs 14*a''*, 14*b''*, 14*c''*, 14*d''* and is fabricated to an outer diameter of something less than the inner diameter of the drop tube (not shown). In this embodiment, the legs have no outward bias and the ring 54 produces no outward buckling or bowing of the legs. The ring 54 and baseplate 12 may be attached to the legs by welding or other conventional manner.

Figure 11:
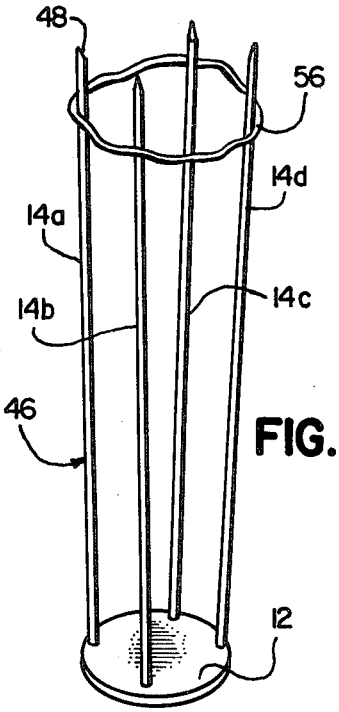
FIG. 11 is a perspective view of a eleventh embodiment of the invention.

In the embodiment 46 shown in FIG. 11, the tops of the legs 14*a*, 14*b*, 14*c*, 14*d* in this embodiment are collectively encircled with an irregular ring 56 of spring stock. The spring bias allows the upper ends 48 of the legs to extend to a greater circumference than that of the fill drop tube (not shown) so that when the shield 46 is inserted into the drop tube, the legs will be forced inwardly by the walls of the drop tube, thereby securing the shield in position.

Although the present invention has been described with reference to the particular embodiments herein set forth, it is understood that the present disclosure has been made only by way of example and that numerous changes in the details of construction may be resorted to without departing from the spirit and scope of the invention. Thus, the scope of the invention should not be limited by the foregoing specification, but rather only by the scope of the claims appended hereto.

What is claimed is:

1. In a shield for protecting a portion of the bottom of a liquid storage tank which underlies the bottom of a cylindrical fill drop tube having a hollow interior defined by sidewalls through which a gauge stick is dropped to measure the liquid level of the tank contents and wherein the bottom of the drop tube defines a space above the tank bottom, the improvement which comprises a combination shielding means and positioning means to interpose a protector between the bottom of the gauge stick and the bottom of the tank, said shielding means comprising a circular baseplate of slightly smaller diameter than the diameter of the drop tube, the baseplate being adapted to be vertically moved within the fill drop tube, the positioning means being permanently affixed to the shielding means and being in sliding engagement within the fill drop tube, said positioning means comprising at least three legs of length greater than the space between the bottom of the tank and the bottom of the fill drop tube, the legs being adopted to position the baseplate in registry below the fill drop tube, the legs each having a first end and a second end, the respective first ends being connected to the baseplate and the respective second ends being in sliding contact and engagement within the interior of the fill drop tube, the said second ends of the legs being biased outwardly of the baseplate, the second ends frictionally engaging the sidewalls within the said hollow interior; and a tie bar interconnecting at least two legs in spaced relation above the baseplate whereby the two connected legs act as a unit to engage simultaneously the interior of the drop tube.

2. The shield of claim 1 wherein the number of legs is four and wherein the tie bar is continuous to define a ring and wherein all of the legs are interconnected by the ring.

3. The shield of claim 2 wherein the ring is attached to the legs near their midpoints between the first and second ends.

4. The shield of claim 2 wherein the ring is attached to the legs near their respective second ends.

5. The shield of claim 2 wherein the ring is split in at least one location.

6. The shield of claim 2 wherein the ring is split in two locations.

7. The shield of claim 2 wherein the diameter of the ring is approximately equal to the diameter of the baseplates.

* * * * *